US010073368B2

(12) United States Patent
Takenaka et al.

(10) Patent No.: US 10,073,368 B2
(45) **Date of Patent: *Sep. 11, 2018**

(54) DEVELOPER WITH TONER AND CARRIER, AND IMAGE FORMING APPARATUS USING THE SAME

(71) Applicants: KABUSHIKI KAISHA TOSHIBA, Tokyo (JP); TOSHIBA TEC KABUSHIKI KAISHA, Tokyo (JP)

(72) Inventors: Sunao Takenaka, Yokohama Kanagawa (JP); Masahiro Ikuta, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/484,670

(22) Filed: Apr. 11, 2017

(65) Prior Publication Data

US 2017/0219946 A1 Aug. 3, 2017

Related U.S. Application Data

(63) Continuation of application No. 14/809,674, filed on Jul. 27, 2015, now Pat. No. 9,645,519.

(30) Foreign Application Priority Data

Sep. 16, 2014 (JP) ..... 2014-188287

(51) Int. Cl.
*G03G 9/00* (2006.01)
*G03G 9/09* (2006.01)
(Continued)

(52) U.S. Cl.
CPC ..... *G03G 9/0926* (2013.01); *G03G 9/0808* (2013.01); *G03G 9/0819* (2013.01);
(Continued)

(58) Field of Classification Search
CPC ..... G03G 9/113; G03G 9/1139
(Continued)

(56) References Cited

U.S. PATENT DOCUMENTS 6,284,421 B1 9/2001 Matsuzaki et al.
8,318,399 B2 11/2012 Hasegawa et al.
(Continued)

FOREIGN PATENT DOCUMENTS

JP H10-232513 9/1998
JP 2009-251483 A 10/2009
(Continued)

OTHER PUBLICATIONS

Japanese Office Action filed Dec. 22, 2017 in counterpart Japanese Patent Application No. 2014-188287 (6 pages) (with machine translation).

*Primary Examiner* — Mark A Chapman
(74) *Attorney, Agent, or Firm* — Patterson & Sheridan, LLP

(57) ABSTRACT

A developer according to an embodiment includes a toner having a color erasable by heating and a carrier. The carrier includes a core portion and a coating portion covering at least 50% of the core portion. The coating portion includes a white-colored additive agent which suppresses an increase in electrification due to friction between the toner and the carrier, a mass of the additive agent being between 20% and 60% of a total mass of the coating portion.

20 Claims, 1 Drawing Sheet

(51) Int. Cl.

| | |
|---|---|
| ***G03G 9/113*** | (2006.01) |
| ***G03G 9/107*** | (2006.01) |
| ***G03G 9/08*** | (2006.01) |
| ***G03G 9/087*** | (2006.01) |
| ***G03G 9/093*** | (2006.01) |
| ***G03G 15/08*** | (2006.01) |

(52) U.S. Cl.
CPC ..... *G03G 9/0823* (2013.01); *G03G 9/08755* (2013.01); *G03G 9/0928* (2013.01); *G03G 9/09328* (2013.01); *G03G 9/09378* (2013.01); *G03G 9/09392* (2013.01); *G03G 9/1075* (2013.01); *G03G 9/113* (2013.01); *G03G 9/1131* (2013.01); *G03G 9/1136* (2013.01); *G03G 9/1139* (2013.01); *G03G 15/08* (2013.01); *G03G 2215/0602* (2013.01)

(58) Field of Classification Search
USPC ..... 430/111.1
See application file for complete search history.

(56) References Cited

U.S. PATENT DOCUMENTS

| | | | | |
|---|---|---|---|---|
| 8,486,600 | B2 | 7/2013 | Fukushima et al. | |
| 9,645,519 | B2 * | 5/2017 | Takenaka ..... | G03G 9/113 |
| 2014/0212153 | A1 | 7/2014 | Tanaka | |
| 2015/0063838 | A1 | 3/2015 | Yagi et al. | |

FOREIGN PATENT DOCUMENTS

| | | | |
|---|---|---|---|
| JP | 2010-144008 | A | 7/2010 |
| JP | 2011-017937 | A | 1/2011 |

* cited by examiner

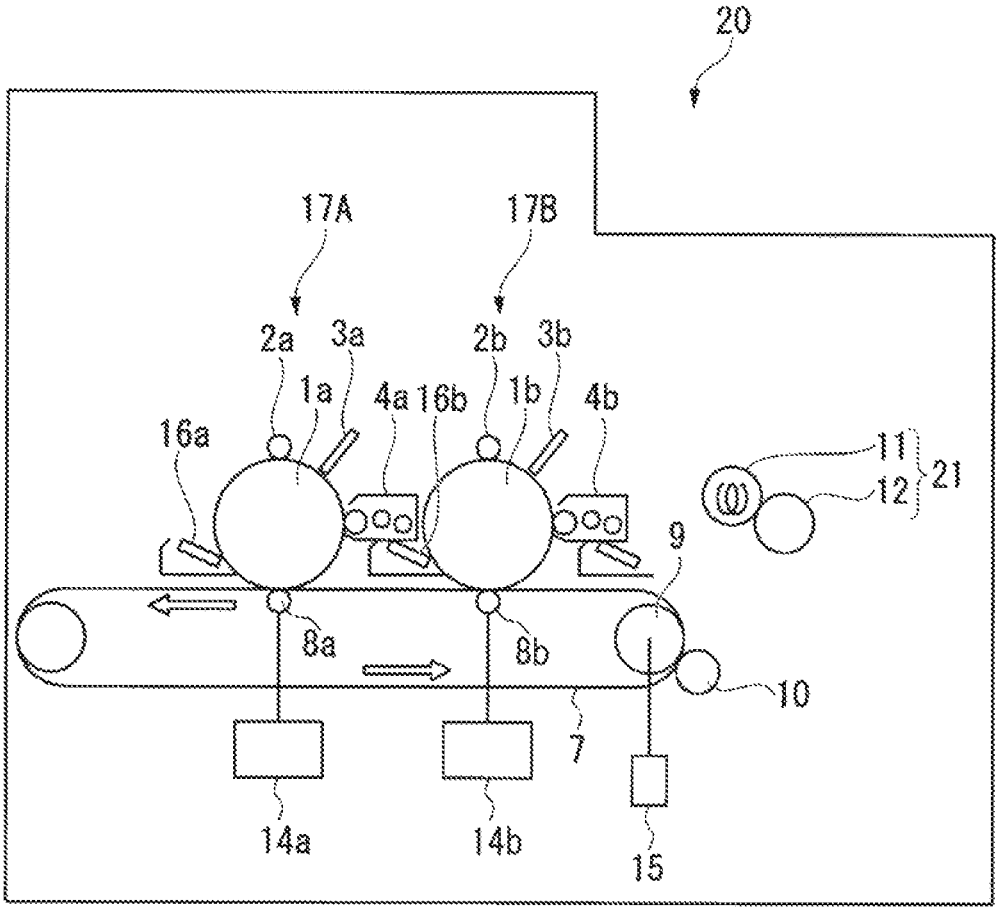
20
17A
17B
2a
3a
2b
3b
1a
4a
16b
1b
4b
16a
11
21
12
9
8a
8b
10
7
14a
14b
15

DEVELOPER WITH TONER AND CARRIER, AND IMAGE FORMING APPARATUS USING THE SAME

CROSS-REFERENCE TO RELATED APPLICATIONS

This application is a continuation application of U.S. patent application Ser. No. 14/809,674, filed on Jul. 27, 2015, which is based upon and claims the benefit of priority from Japanese Patent Application No. 2014-188287, filed on Sep. 16, 2014, the entire contents of each of which are incorporated herein by reference.

FIELD

Embodiments described herein relate generally to a developer, a toner cartridge, and an image forming apparatus.

BACKGROUND

In an electrophotographic image forming apparatus, a two component developer is commonly used at the time of performing development. The two component developer includes a carrier. The carrier has a surface of a core portion covered with a resin or the like. In the core portion, a fine particle magnetic powder of ferrite is generally used. In a coating portion covering the core portion, a conductive agent such as carbon black is generally added for suppressing an increase in electrical resistivity of the carrier. By adding the conductive agent, the electrical resistivity of the carrier is adjusted to be in a suitable range. Thus, an electrification amount of a toner, which is electrified by friction between the toner and the carrier, is controlled to be in a suitable range. Accordingly, in image forming, a decrease in image density is prevented.

Recently, a technology is in practical use in which a developer containing a decoloring toner is used. According to such technology, printing with respect to paper and erasing of a printed portion are repeated, and thus the paper is reused. The decoloring toner is a toner of which a color is erased by heating at an arbitrary temperature.

When the printing is performed with respect to the paper by the decoloring toner, fixing is performed at a temperature lower ($T_L$) than a decoloring temperature ($T_H$). The printed portion formed by the decoloring toner is heated at a temperature greater than or equal to the decoloring temperature ($T_H$), and thus the color of the toner is erased and becomes invisible.

When an image formed on the paper by such a decoloring toner is heated, it is preferable that the toner is made invisible by the heating, and thus the image on the paper cannot be seen by the naked eye.

However, when the two component developer is used, carbon black (in the coating portion of the carrier) or iron oxide (on the surface of the core portion of the carrier) may be adsorbed onto a photoreceptor along with the decoloring toner. In this case, the carbon black or the iron oxide is also attached to the paper along with the decoloring toner. For this reason, even when the paper is heated, the color of the carbon black or the iron oxide appears on the paper, so that a residual image of the erased color occurs. Thus the paper may not be reused.

When the conductive agent is not added to the coating portion of the carrier, the residual image of the erased color rarely occurs. However, when the conductive agent is not added to the coating portion, the electrification amount of the toner is excessively increased by an operation in which the developer is stirred or the like, and thus the development may not be performed.

DESCRIPTION OF THE DRAWING

The FIGURE is a side view illustrating an image forming apparatus.

DETAILED DESCRIPTION

Exemplary embodiments provide a developer, a toner cartridge, and an image forming apparatus by which a residual image of an erased color rarely occurs, and an electrification amount of a toner is able to be stabilized.

A developer according to an embodiment includes a toner having a color erasable by heating and a carrier. The carrier includes a core portion and a coating portion covering at least 50% of the core portion. The coating portion includes an additive agent which suppresses an increase in electrification due to friction between the toner and the carrier. The additive agent has a white color.

Hereinafter, exemplary embodiments will be described with reference to the drawings.

A developer of the embodiment includes a toner (a decoloring toner) of which the color is erased by heating at an arbitrary temperature, and a carrier. The developer of the embodiment is a so-called two component developer.

Hereinafter, a configuration of the decoloring toner will be described.

As the decoloring toner of the embodiment, particles containing a coloring agent and a binder resin may be included.

As the coloring agent, for example, a coloring agent including a coloring compound, a developer, and a decoloring agent may be included.

The coloring compound is an electron donating compound which develops a color by reacting with the developer. As a representative component, a leuco dye may be included.

As the leuco dye, for example, phthalides, azaphthalides, fluorans, styrylquinolines, diazarhodamine lactones, a pyrimidine-based compound, a pyridine-based compound, a quinazoline-based compound, a bisquinazoline-based compound, and the like may be included.

As the phthalides described above, for example, diphenyl methane phthalides such as 3,3-bis(p-dimethylaminophenol)-6-dimethylaminophthalide; indolyl phthalides such as 3,3-bis(1-n-butyl-2-methylindol-3-yl) phthalide; phenylindolyl phthalides such as 3-(4-diethylaminophenyl)-3-(1-ethyl-2-methylindol-3-yl) phthalide, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide, and the like may be included.

As the azaphthalides described above, for example, diphenylmethane azaphthalides such as 3,3-bis(2-ethoxy-4-diethylaminophenyl)-4-azaphthalide; phenylindolyl azaphthalides such as 3-(4-diethylamino-2-hexyloxyphenyl)-3-(1-ethyl-2-methylindol-3-yl)-4-azaphthalide, 3-(2-ethoxy-4-diethylaminophenyl)-3-(1-ethyl-2-methylindol-3-yl)-4-azaphthalide, and 3-[2-ethoxy-4-(N-ethylanilino) phenyl]-3-(1-ethyl-2-methylindol-3-yl)-4-azaphthalide, and the like may be included.

As the fluorans described above, for example, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benzo-6-diethylaminofluoran, 1,2-benzo-6-(N-ethyl-N-isobutylamino)fluoran, 1,2-benzo-6-(N-ethyl-N-isoamylamino)fluoran, and the like may be included.

As the styrylquinolines described above, for example, 2-(3-methoxy-4-dodecoxystyryl)quinoline and the like may be included.

As the pyrimidine-based compound described above, for example, spiro[5H-(1)benzopyrano (2,3-d)pyrimidine-5,1'(3'H)isobenzofuran]-3'-one, 2-(diethylamino)-8-(diethylamino)-4-methyl, spiro[5H-(1)benzopyrano(2,3-d)pyrimidine-5,1'(3'H)isobenzofuran]-3'-one, 2-(di-n-butylamino)-8-(di-n-butylamino)-4-methyl, spiro[5H-(1)benzopyrano(2,3-d)pyrimidine-5,1'(3'H)isobenzofuran]-3'-one, 2-(di-n-butylamino)-8-(diethylamino)-4-methyl, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl, spiro[5H-(1)benzopyrano(2,3-d)pyrimidine-5,1'(3'H)isobenzofuran]-3'-one, 2-(di-n-butylamino)-8-(di-n-butylamino)-4-phenyl, and the like may be included.

One of the coloring compounds may be independently used, or a combination of two or more thereof may be used.

The developer is an electron accepting compound which donates a positive charge to the coloring compound (receives an electron from the coloring compound).

As the developer, for example, phenols such as monophenols and polyphenols; phenol metal salts; metal salts of carboxylic acid; aromatic carboxylic acid or ester thereof; aliphatic carboxylic acid having 2 to 5 carbon atoms; acetophenones; benzophenones; sulphonic acid; sulphonate; phosphoric acids; metal salts of phosphoric acid; acidic phosphoric acid ester; metal salts of acidic phosphoric acid ester; phosphites; phosphite metal salts; triazole or derivatives thereof; bisphenol; trisphenol; a phenol-aldehyde condensation resin; or these materials having a substitution group, and the like may be included.

When the developer includes the substitution group, as the substitution group, an alkyl group, an aryl group, an acyl group, an alkoxycarbonyl group, a hydroxy group, a carboxy group or an ester group thereof, an amide group, a halogen group, and the like may be included.

As the phenols described above, for example, phenol, o-cresol, tertiary-butylcatechol, nonylphenol, n-oxtylphenol, n-dodecylphenol, n-stearylphenol, p-chlorophenol, p-bromophenol, o-phenylphenol, resorcin, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], and the like may be included.

As the aromatic carboxylic acid or the ester thereof described above, for example, n-butyl p-hydroxybenzoic acid, n-oxtyl p-hydroxybenzoic acid, benzyl p-hydroxybenzoic acid, dihydroxybenzoic acid or ester thereof (for example, 2,3-dihydroxybenzoic acid, methyl 3,5-dihydroxybenzoic acid, and the like), gallic acid, dodecyl gallate, ethyl gallate, butyl gallate, propyl gallate, and the like may be included.

As the acetophenones described above, for example, 2,4-dihydroxyacetophenone, 2,5-dihydroxyacetophenone, 2,6-dihydroxyacetophenone, 3,5-dihydroxyacetophenone, 2,3,4-trihydroxyacetophenone, and the like may be included.

As the benzophenones described above, for example, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, and the like may be included.

As the bisphenol described above, for example, 2,4'-biphenol, 4,4'-biphenol, 4,4'-(1-methylethylidene)bisphenol, 4,4'-[1,4-phenylenebis(1-methylethylidene)bis(1,2-benzenediol)], 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 1,1-bis(4-hydroxyphenyl)hexafluoropropane, 2,2-bis(4-hydroxyphenyl)n-heptane, 2,2-bis(4-hydroxyphenyl)n-nonane, and the like may be included.

As the trisphenol described above, for example, 4,4',4"-ethylidene trisphenol, methylene tris-p-cresol, and the like may be included.

One of the developers may be independently used, or a combination of two or more thereof may be used.

The content of the developer in the coloring agent is preferably between 10 and 10000 parts by mass, more preferably between 10 and 5000 parts by mass, and further preferably between 50 and 2000 parts by mass, with respect to 100 parts by mass of the coloring compound.

In the decoloring agent, a decoloring agent which inhibits a color developing reaction between the coloring compound and the developer by heating, and is able to achromatize the color is used.

As the decoloring agent, for example, alcohols, esters, ketones, ethers, acid amides, and the like may be included. Among them, as the decoloring agent, esters are preferable.

As the esters described above, carboxylic acid ester having a substitutional aromatic ring, ester of carboxylic acid having non-substitutional aromatic ring and aliphatic alcohol, ester of carboxylic acid having a non-substitutional aromatic ring and aromatic alcohol, carboxylic acid ester having a cyclohexyl group in a molecule, ester of aliphatic acid and aromatic alcohol, ester of aliphatic acid and phenol, ester of aliphatic acid and linear aliphatic alcohol, ester of aliphatic acid and branched aliphatic alcohol, ester of dicarboxylic acid and aromatic alcohol, ester of dicarboxylic acid and branched aliphatic alcohol, and the like may be included.

As the ester of carboxylic acid having a non-substitutional aromatic ring and aromatic alcohol, for example, dibenzyl cinnamate, and the like may be included.

As the ester of aliphatic acid and aromatic alcohol, for example, 4-benzyl oxyphenylethyl caprylate, and the like may be included.

As the ester of aliphatic acid and linear aliphatic alcohol, for example, n-heptyl palmitate, n-oxtyl palmitate, heptyl stearate, didecyl adipate, dilauryl adipate, dimyristyl adipate, dicetyl adipate, distearyl adipate, and the like may be included.

As the ester of aliphatic acid and branched aliphatic alcohol, for example, trilaurin, trimyristin, tristearin, and the like may be included.

As the ester of dicarboxylic acid and aromatic alcohol, for example, an ester of pimelic acid and 2-(4-benzyl oxyphenol) ethanol, and the like may be included.

One of the decoloring agents may be independently used, or a combination of two or more thereof may be used.

The content of the decoloring agent in the coloring agent is preferably between 100 and 80000 parts by mass, more preferably between 500 and 20000 parts by mass, and further preferably between 500 and 10000 parts by mass, with respect to 100 parts by mass of the coloring compound.

The coloring agent may include a component other than the coloring compound, the developer, and the decoloring agent, according to necessary or desired properties.

One of the coloring agents used in the decoloring agent may be independently used, or a combination of two or more thereof may be used.

The content of the coloring agent in the decoloring toner, is preferably between 5% and 60% mass, and more preferably between 15% and 50% mass, with respect to a total amount of the decoloring toner (excluding an external additive agent described later). When the content of the coloring agent is less than the preferred lower limit value, color developing properties of the toner may be rarely expressed. When the content of the coloring agent exceeds the preferred upper limit value, fixing properties and durability of an image may easily decrease.

When the coloring compound, the developer, and the decoloring agent is used as the coloring agent, it is preferable that these three components are used as capsule particles encapsulated into an encapsulating agent. By using the component as the capsule particles, an influence due to chemical action of other raw materials of the toner is suppressed with respect to the three components. The capsule particles in which the three components are encapsulated, for example, are prepared by a conventionally known method such as an interfacial polymerization method, a coacervation method, an in situ polymerization method, an in-liquid drying method, and an in-liquid hardened film forming method. As the capsulating agent, for example, a multivalent isocyanate prepolymer, a melamine formalin prepolymer, and the like may be included.

As the binder resin used in the decoloring toner, for example, a polyester resin, a polystyrene-based resin, a polyurethane resin, an epoxy resin, and the like may be included. Among them, a polyester resin is preferable for excellent low temperature fixing properties.

Among the polyester resins, a polyester resin having glass transition temperature ($T_G$) of 40° C. to 70° C. is preferable, and a polyester resin having glass transition temperature of 45° C. to 65° C. is more preferable. When $T_G$ of the polyester resin is less than the preferred lower limit value, preservation stability of the decoloring toner is not ensured. On the other hand, when $T_G$ of the polyester resin exceeds the preferred upper limit value, fixing properties may be degraded. The $T_G$ of the resin may be measured by a differential scanning calorimetry.

The polyester resin may be non-crystalline or crystalline.

As the polyester resin described above, for example, a condensation polymer of a bivalent or more carboxylic acid component and a bivalent or more alcohol component may be included.

As the bivalent or more carboxylic acid component, for example, aromatic dicarboxylic acid such as terephthalic acid, phthalic acid, and isophthalic acid; aliphatic dicarboxylic acid such as fumaric acid, maleic acid, succinic acid, adipic acid, sebacic acid, glutaric acid, pimelic acid, oxalic acid, malonic acid, citraconic acid, and itaconic acid; aromatic tricarboxylic acid such as 1,2,4-benzene tricarboxylic acid (trimellitic acid), and the like may be included.

One of the bivalent or more carboxylic acid components may be independently used, or a combination of two or more thereof may be used.

As the bivalent or more alcohol component, for example, aliphatic polyol such as ethylene glycol, propylene glycol, 1,4-butanediol, 1,3-butanediol, 1,5-pentanediol, 1,6-hexanediol, neopentyl glycol, glycerol, trimethylene glycol, trimethylol propane, pentaerythritol, and sorbitol; alicyclic diol such as 1,4-cyclohexanediol and 1,4-cyclohexanedimethanol; aromatic polyol such as bisphenol A, and the like may be included.

One of the bivalent or more alcohol components may be independently used, or a combination of two or more thereof may be used.

One of the binder resins used in the decoloring toner may be independently used, or a combination of two or more thereof may be used.

The content of the binder resin in the decoloring toner is preferably between 50% and 90% mass, and more preferably between 60% and 80% mass, with respect to the total amount of the decoloring toner (excluding the external additive agent described later). When the content of the binder resin is less than the preferred lower limit value, fixing properties and durability of the image are not ensured. When the content of the binder resin exceeds the preferred upper limit value, toner scattering may rarely occur.

The decoloring toner of the embodiment may contain a component (an arbitrary toner component) other than the coloring agent and the binder resin, according to desired or necessary properties. As the arbitrary toner component, for example, a release agent, a surfactant, an aggregating agent, an electrification controlling agent, an external additive agent, a basic compound, a silane coupling agent, and the like may be included.

It is preferable that the decoloring toner of the embodiment contains a release agent for improving fixing properties and the like.

As the release agent, for example, aliphatic hydrocarbon-based wax such as low molecular polyethylene, low molecular polypropylene, a polyolefin copolymer, polyolefin wax, microcrystalline wax, paraffin wax, and Fischer Tropsch wax; an oxide of aliphatic hydrocarbon-based wax such as polyethylene oxide wax, or a block copolymer thereof; vegetable waxes such as candelilla wax, carnauba wax, Japan wax, jojoba wax, and rice wax; animal waxes such as beeswax, lanolin, and whale wax; mineral waxes such as ozokerite, ceresin, and petrolactam; palmitic acid ester wax, montanic acid ester wax, waxes such as castor wax having aliphatic acid ester as a main component; waxes such as de-oxidized carnauba wax in which a part or all of aliphatic acid ester is deoxidized; saturated linear aliphatic acid such as palmitic acid, stearic acid, montanic acid, or long-chain alkyl carboxylic acid having a long-chain alkyl group; unsaturated aliphatic acid such as brassidic acid, eleostearic acid, and parinaric acid; saturated alcohol such as stearyl alcohol, eicosyl alcohol, behenyl alcohol, carnaubyl alcohol, ceryl alcohol, melissyl alcohol, or long-chain alkyl alcohol having a long-chain alkyl group; multivalent alcohol such as sorbitol; aliphatic acid amide such as linoleic acid amide, oleic acid amide, and lauric acid amide; saturated aliphatic acid bisamide such as methylenebisstearic acid amide, ethylenebiscapric acid amide, ethylenebislauric acid amide, and hexamethylenebisstearic acid amide; unsaturated aliphatic acid amide such as ethylenebisoleic acid amide, hexamethylenebisoleic acid amide, N,N'-dioleyladipic acid amide, and N,N'-dioleylsebacic acid amide; aromatic bisamide such as M-xylenebisstearic acid amide, and N,N'-distearylisophthalicacidamide; a metal salt of aliphatic acid (in general, metal soap) such as calcium stearate, calcium laurate, zinc stearate, and magnesium stearate; wax in which aliphatic hydrocarbon-based wax is grafted by using a vinyl-based monomer such as styrene or acrylic acid; a partially esterified compound of aliphatic acid such as behenateic acid monoglyceride and multivalent alcohol; and a methyl ester compound having a hydroxy group which is obtained by hydrogenating vegetable oil may be included.

One of the release agents used in the decoloring agent may be independently used, or a combination of two or more thereof may be used.

The decoloring toner of the embodiment may contain a surfactant.

As the surfactant, for example, an anionic surfactant such as an ester salt of sulfuric acid, an ester salt of sulfonic acid, an ester salt of phosphoric acid, and soap; a cationic surfactant such as an amine salt, and a quaternary ammonium salt; an nonionic surfactant such as a polyethylene glycol-based surfactant, an alkyl phenol ethylene oxide adduct-based surfactant, or a multivalent alcohol-based surfactant, and the like may be included. These surfactants may be high molecular.

The decoloring toner of the embodiment may contain an aggregating agent.

As the aggregating agent, for example, a metal salt such as sodium chloride, calcium chloride, calcium nitrate, barium chloride, magnesium chloride, zinc chloride, magnesium sulfate, aluminum chloride, aluminum sulfate, and potassium aluminum sulfate; a non-metal salt such as ammonium chloride, and ammonium sulfate; an inorganic metal salt polymer such as polyaluminum chloride, polyaluminum hydroxide, and calcium polysulfide; a high molecular aggregating agent such as polymethacrylic acid ester, polyacrylic acid ester, polyacrylamide, and an acrylamide sodium acrylate copolymer; a condensing agent such as polyamine, polydiallyl ammonium halide, polydiallyl dialkyl ammonium halide, melamine formaldehyde condensate, and dicyan diamide; alcohols such as methanol, ethanol, 1-propanol, 2-propanol, 2-methyl-2-propanol, 2-methoxy ethanol, 2-ethoxy ethanol, and 2-butoxy ethanol; an organic solvent such as acetonitrile, and 1,4-dioxane; inorganic acid such as hydrochloric acid, and nitric acid; organic acid such as formic acid and acetic acid, and the like may be included. Among them, from a viewpoint of a high facilitation effect of the aggregation, the non-metal salt is preferable, and the ammonium sulfate is more preferable.

The decoloring toner of the embodiment may contain the electrification controlling agent. The decoloring toner contains the electrification controlling agent, and thus electrification properties of the toner are controlled.

As the electrification controlling agent, for example, a metal-containing azo compound, a metal-containing salicylic acid derivative compound, and the like may be included. Among metal-containing azo compounds, a complex or a complex salt in which the metal is iron, cobalt or chromium, or a mixture thereof is preferred. Among the metal-containing salicylic acid derivative compounds, a complex or a complex salt in which the metal is zirconium, zinc, chromium or boron, or a mixture thereof is preferred.

The decoloring toner of the embodiment may contain the external additive agent. In the external additive agent, for example, inorganic fine particles are used for imparting liquidity to the toner, for adjusting electrification properties, or the like. As an inorganic substance configuring the inorganic fine particles, for example, silica, titania, alumina, strontium titanate, tin oxide, and the like may be included. One of the inorganic fine particles may be independently used, or a combination of two or more thereof may be used.

As the external additive agent, for improving environment stability, it may be preferable that the inorganic fine particles are subjected to a surface treatment by a hydrophobizing agent. In addition, in the external additive agent, in order to improve cleaning properties, resin fine particles having a particle diameter of less than or equal to 1 μm are able to be used. As a resin configuring the resin fine particles, for example, a styrene acrylic acid copolymer, a polymethyl methacrylate, a melamine resin, and the like may be included.

It is preferable that the content of the external additive agent in the decoloring toner is approximately between 0.01% and 20% mass with respect to the total amount of the decoloring toner (including the external additive agent).

The decoloring toner of the embodiment, for example, is manufactured by a chemical manufacturing method. As the chemical manufacturing method described above, for example, a manufacturing method including an aggregating step, a fusing step, a cleaning step, a drying step, and an externally adding step may be included.

In the aggregating step, for example, a dispersion liquid of coloring agent particles and a dispersion liquid of binder resin particles are mixed in an aqueous solvent. Accordingly, the coloring agent particles and the binder resin particles are aggregated, and thus an aggregated body is obtained. When the dispersion liquid of the coloring agent particles and the dispersion liquid of the binder resin particles are mixed, an arbitrary toner component such as a release agent may be added. In addition, a release agent or the like may be included in the dispersion liquid of the binder resin particles.

In the fusing step, the aggregated body obtained in the aggregating step described above is subjected to a heat treatment. Accordingly, the coloring agent particles and the binder resin particles configuring the aggregated body are fused, and thus fused particles are obtained. The operation of the fusing step may be performed simultaneously with the operation of the aggregating step described above.

The cleaning step is suitably performed by a known cleaning method. For example, the cleaning step is performed by repeating cleaning with water and filtering. The cleaning step, for example, is repeated until electric conductivity of a filtrate is less than or equal to 50 μS/cm.

The drying step is a step in which the fused particles after the cleaning step described above is dried. The drying step is suitably performed by a known drying method.

In the externally adding step, the fuse particle group (after the drying step described above) and an external additive agent are mixed, and a particle group of an aimed decoloring toner is obtained.

A volume average particle diameter of the particle group of the decoloring toner of the embodiment is preferably approximately 7 μm to 12 μm, and more preferably approximately 8 μm to 10 μm. When the volume average particle diameter of the particle group of the decoloring toner is greater than or equal to the preferred upper limit value described above, a reproduction of a high definition image is difficult. On the other hand, when the volume average particle diameter of the particle group of the decoloring toner is less than or equal to the preferred lower limit value described above, the control of the toner in the development and the transfer is difficult.

In this embodiment, the volume average particle diameter of the particle group is able to be measured by a particle size distribution measurement device.

One of the decoloring toners included in the developer of the embodiment may be independently used, or a combination of two or more thereof may be used.

The content of the decoloring toner in the developer of the embodiment is preferably between 7% and 10% mass, and is more preferably between 8% and 9% mass, with respect to the total amount of the developer. When the content of the decoloring toner is greater than or equal to the preferred lower limit value described above, preferred development properties are easily obtained. On the other hand, when the content of the decoloring toner is less than or equal to the preferred upper limit value described above, problems such as blushing or toner scattering may rarely occur.

An image formed by using the decoloring toner of the embodiment is heated at a temperature higher than or equal to the decoloring temperature ($T_H$), which is higher than a fixation temperature, and thus the color of the toner is erased and the image becomes invisible. Even when an image portion is cooled to a temperature lower than the decoloring temperature ($T_H$), a state where the image is invisible is maintained for a while. Further, when the image portion is cooled to a temperature lower than or equal to a recoloring temperature ($T_C$), the decoloring toner develops a color and the image appears. It is preferable that the recoloring temperature ($T_C$) is lower than or equal to −10° C. When the recoloring temperature ($T_C$) is less than or equal to the preferred upper limit value described above, the state where the image is not visible is maintained at room temperature, and a storage medium may be easily reused.

Hereinafter, a configuration of the carrier will be described.

The carrier of the embodiment is particles including a granular core portion, and a coating portion covering the core portion.

As a material constituting the core portion of the carrier of the embodiment, for example, magnetite powders, iron powders, ferrite powders, glass beads, and the like may be included.

The coating portion of the carrier of the embodiment includes an additive agent for suppressing an increase in electrification. The coating portion includes the additive agent, and thus an increase in electrification amount of the decoloring toner is suppressed.

The additive agent included in the coating portion has a white color. Here, the "white color" indicates whiteness to the extent of being visually perceived. The additive agent has a white color, and thus even when the additive agent is adsorbed onto the photoreceptor along with the decoloring toner, a residual image of an erased color rarely occurs at the time of heating the formed image at a temperature higher than or equal to the decoloring temperature ($T_H$).

As the additive agent, $TiO_2$, ZnO, $Al_2O_3$, $SnO_2$, other metal powders having a white color, and the like may be included. Among them, one or more selected from a group consisting of $TiO_2$, ZnO, $Al_2O_3$, and $SnO_2$ is preferable.

One of the additive agents included in the coating portion may be independently used, or a combination of two or more thereof may be used.

A ratio of the additive agent included in the coating portion is preferably between 20% and 60% mass, more preferably between 25% and 55% mass, and further preferably between 30% to 50% mass, with respect to the total amount of the coating portion. When the ratio of the additive agent is greater than or equal to the preferred lower limit value described above, an increase in electrification amount of the toner may be more easily suppressed. On the other hand, when the ratio of the additive agent is less than or equal to the preferred upper limit value described above, the additive agent may be more stably blended to the coating portion. In addition, the residual of the erased color may be more easily suppressed.

In the coating portion of the carrier of the embodiment, a resin component is generally included as a film forming component in addition to the additive agent. As the resin component, a silicone resin, an acrylic resin, and the like may be included.

The coating portion may include a component (a coating portion arbitrary component) in addition to the additive agent and the film forming component, according to necessary or desired properties. As the coating portion arbitrary component, for example, an electrification controlling agent which is generally used as a toner, a silane coupling agent, and the like may be included.

In the carrier of the embodiment, a mass ratio denoted by coating portion/core portion is preferably between 0.004 and 0.02, and is more preferably between 0.01 and 0.02. When coating portion/core portion ratio is greater than or equal to the preferred lower limit value described above, abrasion resistance of the coating portion may further increase. On the other hand, when the coating portion/the core portion is less than or equal to the preferred upper limit value described above, an increase in electrification of the carrier may be easily suppressed.

The "mass ratio denoted by coating portion/core portion" indicates a ratio of a content (by mass) of all components included in the coating portion to a content (by mass) of all components included in the core portion.

In the carrier of the embodiment, the granular core portion is covered with the coating portion.

Here, "cover" indicates that a ratio of an occupancy area of the coating portion to a total surface area of the carrier particles is greater than or equal to 50%. An increase in electrification amount of the toner is easily suppressed as the ratio of the occupancy area of the coating portion becomes higher.

That is, the ratio of the occupancy area of the coating portion to the surface area of the carrier particles is greater than or equal to 50%, and is preferably greater than 50%. When the ratio of the occupancy area of the coating portion is greater than or equal to the lower limit value described above, an increase in electrification amount of the toner may be suppressed, and the electrification amount of the toner is stabilized.

The ratio of the occupancy area of the coating portion to the surface area of the carrier particles is calculated by the following procedure.

Step (1): In a SEM image of a surface of the carrier particles, element mapping (SEM-EDX) is performed by energy dispersion type X-ray analysis (EDX analysis).

Step (2): In the EDX analysis, an element derived from the component included in the coating portion is a detection target. The color of the element of the detection target is designated to a specific color. Then, in the SEM image of the surface of the carrier particles, a portion in which the element of the detection target is detected is indicated in a specific color. In addition, a portion in which the element of the detection target is not detected is indicated in a color other than the specific color.

Step (3): An area of a range (that is, the coating portion) indicated in the specific color is digitized by the number of pixels of the SEM image. In addition, an area of a range (that is, an exposed core portion) indicated in the color other than the specific color is digitized by the number of pixels of the SEM image.

Step (4): A total area of the area of the range (the coating portion) indicated in the specific color, and the area of the range (the exposed core portion) indicated in the color other than the specific color is determined to be a surface area of the carrier particles. Accordingly, the ratio of the occupancy area of the coating portion to the surface area of the carrier particles is calculated.

Electrical resistivity of the carrier of the embodiment is preferably between $8\times10^{8}$ and $8\times10^{10}$ (Ω·cm), more preferably between $3\times10^{9}$ and $5\times10^{10}$ (Ω·cm), and further preferably between $5\times10^{9}$ and $2\times10^{10}$ (Ω·cm).

When the electrical resistivity of the carrier is greater than or equal to the preferred lower limit value described above, carrier adsorption with respect to the photoreceptor may be easily suppressed. On the other hand, when the electrical resistivity of the carrier is less than or equal to the preferred upper limit value described above, an excessive increase in the toner electrification amount may be easily suppressed.

In this embodiment, electrical resistivity is measured by the following procedure.

Step (i): The carrier is attached to a magnet roller, and a carrier layer is formed on the magnet roller.

Step (ii): The carrier layer is brought into contact with a pair of aluminum electrodes having a predetermined distance (approximately 0.3 mm to 0.4 mm) therebetween (that is, the aluminum electrodes are connected to each other through the carrier layer).

Step (iii): A predetermined voltage is applied between the aluminum electrodes, a current flowing the carrier layer is measured, and thus a resistance value (Ω) is obtained. Then, electrical resistivity is calculated from the resistance value (Ω), a cross-sectional area ($cm^2$) of the carrier layer, and the distance (cm) between the pair of aluminum electrodes.

The volume average particle diameter of the particle group of the carrier of the embodiment is preferably between approximately 35 μm and 45 μm, and more preferably between approximately 37 μm and 43 μm. When the volume average particle diameter of the particle group of the carrier is greater than or equal to the preferred lower limit value described above, carrier adsorption with respect to the photoreceptor may rarely occur. On the other hand, when the volume average particle diameter of the particle group of the carrier is less than or equal to the preferred upper limit value described above, an electric charge having a sufficient electrification amount can be applied to the decoloring toner.

One of the carriers included in the developer of the embodiment may be independently used, or a combination of two or more thereof may be used.

The content of the carrier in the developer of the embodiment is preferably between 90% and 93% mass, and more preferably between 91% and 92% mass, with respect to the total amount of the developer. When the content of the carrier is greater than or equal to the preferred lower limit value described above, an electric charge having a sufficient electrification amount may be applied to the decoloring toner. On the other hand, when the content of the carrier exceeds the preferred upper limit value described above, a decoloring toner concentration decreases, and thus a desired image density may not be obtained.

The carrier of the embodiment, for example, may be manufactured by a fluid bed method, a dipping method, and the like.

The fluid bed method, for example, is a method in which a material for forming a coating portion is sprayed to the core portion in a fluid bed. The dipping method is a method in which the core portion is dipped in the material for forming a coating portion.

In the fluid bed method, the amount of the material for forming a coating portion sprayed to the core portion is controlled, and a mass ratio denoted by the coating portion/the core portion, and the ratio of the occupancy area of the coating portion to the surface area of the carrier particles are adjusted.

In the dipping method, a dipping time, and temperature conditions at the time of the dipping are controlled, and thus the mass ratio denoted by the coating portion/the core portion, the ratio of the occupancy area of the coating portion to the surface area of the carrier particles are adjusted. In addition, a contact ratio of the material for forming a coating portion to the surface of the core portion is controlled, and thus the mass ratio denoted by the coating portion/the core portion, the ratio of the occupancy area of the coating portion to the total surface area of the carrier particles are adjusted. In addition, a concentration of a solid content in the material for forming a coating portion is controlled, and thus the mass ratio denoted by coating portion/core portion, and the ratio of the occupancy area of the coating portion to the surface area of the carrier particles are adjusted.

When the carrier is manufactured, the "mass ratio denoted by coating portion/core portion" is adjusted, and thus the entire surface of the granular core portion is easily covered with the coating portion. In addition, the ratio of the occupancy area of the coating portion to the surface area of the carrier particles is able to be easily controlled such that the ratio is greater than or equal to 50%.

The developer of the embodiment is prepared by mixing the particle group of the decoloring toner with the particle group of the carrier using an ordinary method.

The developer of the embodiment may contain a component (a developer arbitrary component) in addition to the decoloring toner and the carrier, according to desired or necessary properties.

As the developer arbitrary component, for example, a resin fine particle group of a styrene/acryl copolymer, a polyacrylic acid polymer, a melamine polymer, and the like may be included. As the resin fine particle group, MP-300 (a particle diameter of 0.10 μm), MP-1451 (a particle diameter of 0.15 μm), MP-2200 (a particle diameter of 0.35 μm), MP-1000 (a particle diameter of 0.40 μm), MP-2701 (a particle diameter of 0.40 μm), MP-5000 (a particle diameter of 0.40 μm), MP-5500 (a particle diameter of 0.40 μm), and MP-4009 (a particle diameter of 0.60 μm) which are manufactured by Soken Chemical & Engineering Co., Ltd.; P2000 (a particle diameter of 0.48 μm) manufactured by Nippon Paint Co., Ltd.; Epostar S (a particle diameter of 0.20 μm), Epostar FS (a particle diameter of 0.20 μm), and Epostar S6 (a particle diameter of 0.40 μm) which are manufactured by Nippon Shokubai Co., Ltd., and the like may be included.

One of the resin fine particle groups included in the developer of the embodiment may be independently used, or a combination of two or more thereof may be used. The content of the resin fine particle group in the developer of the embodiment is approximately between 0.01 and 0.36 parts by mass with respect to 100 parts by mass of the decoloring toner.

The developer of the embodiment described above contains the decoloring toner, and the carrier with the core portion covered with the coating portion including the additive agent which suppresses an increase in electrification. The core portion of the carrier is covered with the coating portion including the additive agent, and thus an excessive increase in the toner electrification amount is suppressed at the time of stirring the developer. That is, the electrification amount of the toner which is electrified by friction between the toner and the carrier is controlled in a suitable range, and the electrification amount of the toner is stabilized.

In addition, the additive agent included in the coating portion has a white color. For this reason, even when the additive agent is adsorbed onto the photoreceptor along with the decoloring toner, the residual of the erased color rarely occurs at the time of heating the image at a temperature higher than or equal to the decoloring temperature ($T_H$). Accordingly, the storage medium may be more easily reused.

The developer of the embodiment, for example, is stored in an image forming apparatus such as a multifunction peripheral device (MFP) and a color copy machine, and is able to be used for forming an image on an electrophotographic storage medium.

Hereinafter, a toner cartridge of the embodiment will be described.

The developer of the embodiment described above is stored in a container of the toner cartridge of the embodiment. In the container, a known container is able to be used.

The toner cartridge of the embodiment is used in the image forming apparatus, and thus an image having excellent color developing properties is formed on a storage medium. In addition, the image is formed on the storage medium in which the residual of the erased color rarely occurs at the time of being heated at a temperature higher than the decoloring temperature ($T_H$).

Hereinafter, an image forming apparatus of the embodiment will be described with reference to the drawing.

The developer of the embodiment described above is stored in a device main body of the image forming apparatus of the embodiment. In the device main body, a general electrophotographic device is able to be used.

The FIGURE is a diagram illustrating a schematic structure of an image forming apparatus.

An image forming apparatus 20 includes a device main body provided with an intermediate transfer belt 7, a first image forming unit 17A and a second image forming unit 17B which are sequentially disposed on the intermediate transfer belt 7, and a fixing device 21 which is disposed on the downstream thereof. The first image forming unit 17A is disposed on the downstream of the second image forming unit 17B along a movement direction of the intermediate transfer belt 7, that is, along a proceeding direction of an image forming process. The fixing device 21 is disposed on the downstream of the first image forming unit 17A.

The first image forming unit 17A includes a photoreceptor drum 1*a*, a cleaning device 16*a*, an electrification device 2*a*, an exposure device 3*a*, and a first developing device 4*a* which are sequentially disposed on the a photoreceptor drum 1*a*. A primary transfer roller 8*a* is disposed to face the photoreceptor drum 1*a* through the intermediate transfer belt 7.

The second image forming unit 17B includes a photoreceptor drum 1*b*, a cleaning device 16*b*, an electrification device 2*b*, an exposure device 3*b*, and a second developing device 4*b* which are sequentially disposed on the photoreceptor drum 1*b*. A primary transfer roller 8*b* is disposed to face the photoreceptor drum 1*b* through the intermediate transfer belt 7.

The developer of the embodiment described above is stored in the first developing device 4*a*, and in the second developing device 4*b*. The toner may be supplied from a toner cartridge (not illustrated).

A primary transfer power source 14*a* is connected to the primary transfer roller 8*a*. A primary transfer power source 14*b* is connected to the primary transfer roller 8*b*.

On the downstream side of the first image forming unit 17A in a sheet conveying direction, a secondary transfer roller 9 and a backup roller 10 are arranged to face each other through the intermediate transfer belt 7. A secondary transfer power source 15 is connected to the secondary transfer roller 9.

The fixing device 21 includes a heat roller 11 and a press roller 12 which are arranged to face each other.

An image, for example, is formed by the image forming apparatus 20 as described later.

First, the photoreceptor drum 1*b* is uniformly electrified by the electrification device 2*b*. Next, exposure is performed by the exposure device 3*b*, and thus an electrostatic latent image is formed. Next, the development is performed by the developer of the embodiment which is supplied from the developing device 4*b*, and thus a second toner image is obtained.

Subsequently, the photoreceptor drum 1*a* is uniformly electrified by the electrification device 2*a*. Next, exposure is performed by the exposure device 3*a* on the basis of first image information (a second toner image), and thus an electrostatic latent image is formed. Next, the development is performed by the developer of the embodiment which is supplied from the developing device 4*a*, and thus a first toner image is obtained.

The second toner image and the first toner image are transferred onto the intermediate transfer belt 7 by the primary transfer rollers 8*a* and 8*b* in this order.

An image in which the second toner image and the first toner image are layered on the intermediate transfer belt 7 in this order is secondarily transferred onto the storage medium (not illustrated) through the secondary transfer roller 9 and the backup roller 10. Accordingly, the image is formed in which the first toner image and the second toner image are layered on the storage medium in this order.

The storage medium to which the toner image is transferred is transported to the fixing device 21. When the storage medium passes between the heat roller 11 and the press roller 12, the storage medium is pressed, and is heated at a fixing temperature ($T_L$) lower than the decoloring temperature ($T_H$). Accordingly, the toner image is fixed to the storage medium in a state of developing a color.

The type of coloring agent used for the decoloring toner in the developing device 4*a* and the developing device 4*b* is arbitrarily selected. The image forming apparatus 20 illustrated in the FIGURE includes two developing devices, and may include three or more developing devices according to the type of decoloring toner to be used.

According to the image forming apparatus, the image having excellent color developing properties is formed on the storage medium. In addition, the image is formed on the storage medium in which the residual image of the erased color rarely occurs at the time of being heated at a temperature higher than or equal to the decoloring temperature ($T_H$).

When the image formed on the storage medium is eliminated, a portion of the storage medium on which the image is formed is heated at a temperature higher than or equal to the decoloring temperature ($T_H$). In the device (an eliminating device) used for eliminating the image, a device which is able to heat the storage medium at a temperature higher than or equal to the decoloring temperature ($T_H$) higher than the fixation temperature is used. As the eliminating device, for example, a device including a heating unit is included. In the heating unit, the storage medium is heated by being interposed between a pair of rollers.

According to one or more embodiments described above, the core portion of the carrier is covered with the coating portion including the additive agent which suppresses an increase in electrification, and thus the electrification amount of the toner is stabilized. In addition, the additive agent included in the coating portion has a white color, and thus the image is formed in which the residual image of the erased color rarely occurs by being heated at a temperature higher than or equal to the decoloring temperature ($T_H$).

EXAMPLES

The following examples describe an example embodiment. However, the embodiments are not limited to this example.

Hereinafter, a preparing method of the dispersion liquid of the coloring agent particles (a coloring agent dispersion liquid) will be described.

As the coloring compound, 1 part by mass of 3-(2-ethoxy-4-diethylaminophenyl)-3-(1-ethyl-2-methylindol-3-yl)-4-azaphthalide which is a leuco dye was used. As the developer, 5 parts by mass of 2,2-bis(4-hydroxyphenyl) hexafluoropropane was used. As the decoloring agent, 50 parts by mass of a diester compound of pimelic acid and 2-(4-benzyloxyphenyl) ethanol was used.

The coloring compound, the developer, and the decoloring agent were melted and mixed while being heated, and thus a uniform mixture was obtained. 20 parts by mass of an aromatic multivalent isocyanate prepolymer as the capsulating agent and 40 parts by mass of ethyl acetate were mixed to this mixture, and thus a mixed solution was obtained. The obtained mixed solution was dispersed in 250 parts by mass of an aqueous polyvinyl alcohol solution of 8 mass %, and was continuously stirred at 70° C. for approximately one hour. After that, 2 parts by mass of aqueous aliphatic-modified amine was added as a reactant, the mixture was continuously stirred for approximately 1.5 hours while increasing a liquid temperature to 90° C., and a capsule particle dispersion element in which achromatic capsule particles were dispersed was obtained.

The capsule particle dispersion was stored in a freezing store, and thus the dispersion liquid of the capsule particles (the coloring agent particles) (the coloring agent dispersion liquid) in which a blue color was developed was obtained.

A volume average particle diameter of the coloring agent dispersion liquid was measured by SALD7000 (manufactured by Shimadzu Corporation), and thus the volume average particle diameter of the particle group of the coloring agent particles was 1.0 μm. In addition, a complete decoloring temperature of the coloring agent was 79° C., and a complete color developing temperature was −30° C.

Hereinafter, a preparation method of a dispersion liquid of mixed particles (a mixed dispersion liquid) of the binder resin and the release agent will be described.

95 parts by mass of a polyester resin (Tg of 52° C.) as the binder resin, and 5 parts by mass of ester wax as the release agent were mixed, and thus a mixture was obtained. After that, the mixture was melted and kneaded by a biaxial kneader of which the temperature was set to 120° C., and thus a kneaded composition was obtained.

The obtained kneaded composition was coarsely pulverized by using Hammer Mill (manufactured by Nara Machinery Co., Ltd.), and thus a particle group of the coarse particles (a volume average particle diameter of 1.2 mm) was obtained.

The obtained coarse particles were secondarily pulverized by using Bantam Mill (manufactured by Hosokawa Micron Corporation), and thus a particle group of secondarily pulverized particles (a volume average particle diameter of 0.05 mm) was obtained.

Thirty 30 parts by mass of the particle group of the secondarily pulverized particles, 1.2 parts by mass of sodium alkylbenzenesulphonate as the anionic surfactant, 1 part by mass of triethylamine as an amine compound, and 67.8 parts by mass of ion exchange water were mixed at 160 MPa and 180° C. by using a high pressure emulsification device NANO3000, and thus the dispersion liquid of the mixed particles (the mixed dispersion liquid) of the binder resin and the release agent was obtained.

A volume average particle diameter of the mixed dispersion liquid was measured by SALD7000 (manufactured by Shimadzu Corporation), and thus the volume average particle diameter of the particle group of the mixed particles was 500 nm.

Hereinafter, a manufacturing method of the decoloring toner will be described.

Fifteen parts by mass of the mixed dispersion liquid, 1.7 parts by mass of the coloring agent dispersion liquid, and 68.5 parts by mass of the ion exchange water were mixed, and thus a mixed liquid was obtained. Five parts by mass of an aqueous aluminum sulfate solution of 5% mass as the aggregating agent was added to the obtained mixed liquid at 30° C. After that, the mixed liquid to which the aggregating agent was added was heated up to 40° C., and was allowed to stand for one hour (the aggregating step).

Subsequently, 10 parts by mass of an aqueous sodium polycarboxylate solution of 10% mass as the surfactant was added to the mixed liquid prepared in the aggregating step. After that, the mixed liquid to which the surfactant was added was heated up to 70° C., and was placed for 1 hour (the fusing step).

Subsequently, the mixed liquid prepared in the fusing step was cooled, and then a centrifugal separation operation was performed by using a centrifugal machine, and thus a supernatant solution was separated from a solid material. After that, the supernatant solution was eliminated, and then cleaning and filtering were repeated with respect to the solid material by using ion exchange water. The operation of repeating the cleaning and the filtering was repeated until electric conductivity of a filtrate was less than or equal to 50 μS/cm (the cleaning step).

Subsequently, the solid material after the cleaning step was dried by a vacuum drier until a moisture content was less than or equal to 1.0% mass, and thus the particle group of the toner particles was obtained (the drying step).

Subsequently, the obtained toner particles, and 2 parts by mass of hydrophobic silica and 0.5 parts by mass of titanium oxide with respect to 100 parts by mass of the obtained toner particles were mixed. Accordingly, the decoloring toner in which the hydrophobic silica and the titanium oxide were attached to the surface of the toner particles was obtained (the externally adding step).

A volume average particle diameter of the obtained decoloring toner was measured by SALD-7000 (manufactured by Shimadzu Corporation). The volume average particle diameter was 9.8 μm.

Hereinafter, a manufacturing example (the first manufacturing example) of the carrier will be described.

In this example, as described later, each carrier shown in Table 1 was manufactured by a dipping method.

All of the core portions of the respective carriers were formed of a Mn—Mg ferrite powder of which a part was substituted by SrO.

The coating portion of each of the carriers was formed of a silicone resin or was formed by dispersing an additive agent in the silicone resin. As the silicone resin, a silicone resin SR-2411 (manufactured by Dow Corning Toray Co., Ltd.) was used.

Manufacturing of Carriers (1) and (2):

$TiO_2$ as an additive agent was dispersed in a solvent, and thus an additive agent dispersion liquid (x) was prepared.

Separately, the silicone resin was dispersed in the solvent, and thus a silicone resin dispersion liquid was prepared.

Subsequently, the additive agent dispersion liquid (x) and the silicone resin dispersion liquid were mixed, and thus a material for forming a coating portion was obtained.

Subsequently, the core portion of the carrier (the Mn—Mg ferrite powder of which a part was substituted by SrO) was suitably dipped in the obtained material for forming a coating portion.

After that, a heat treatment was performed, and thus carriers (1) and (2) shown in Table 1 were respectively manufactured.

Manufacturing of Carriers (3), (4), (8), (9) and (11):

As the material for forming a coating portion, the silicone resin dispersion liquid was used.

The core portion of the carrier (the Mn—Mg ferrite powder of which a part was substituted by SrO) was suitably dipped in the material for forming a coating portion (without the additive agent).

After that, the heat treatment was performed, and thus carriers (3), (4), (8), (9), and (11) shown in Table 1 were respectively manufactured.

Manufacturing of Carriers (5), (6), (7), (10), and (12):

Carbon black as the additive agent was dispersed in the solvent, and thus an additive agent dispersion liquid (y) was prepared.

Subsequently, the additive agent dispersion liquid (y) and the silicone resin dispersion liquid were mixed, and thus a material for forming a coating portion was obtained.

Subsequently, the core portion of the carrier (the Mn—Mg ferrite powder of which a part was substituted by SrO) was suitably dipped in the obtained material for forming a coating portion.

After that, the heat treatment was performed, carriers (5), (6), (7), (10), and (12) shown in Table 1 were respectively manufactured.

The ratio of the occupancy area of the coating portion to the surface area of the carrier particles was calculated by the following procedure.

Step (1): In a SEM image of the surface of the carrier particles, element mapping (SEM-EDX) was performed by energy dispersion type X-ray analysis (EDX analysis). Specifically, the measurement was performed by using EDX (manufactured by Bruker Japan Co., Ltd., QX-400) attached to SEM (manufactured by Carl Zeiss, Ultra 55). The measurement conditions were as follows.

Acceleration Voltage: 7.5 kV,

Aperture Diameter: 120 μm (High Current Mode),

Operation Distance (WD): 8 mm, and

Magnification of SEM Image: 2000 times.

Step (2): In the EDX analysis, an element (Si) derived from a component (a silicone resin) which was included in the coating portion was a detection target. In the SEM image of the surface of the carrier particles, the element (Si) as the detection target was designated with a red color. In addition, a portion in which the element as the detection target was not detected was designated with a blue color.

Step (3): An area of a range (that is, the coating portion) which is indicated in a red color was digitized by the number of pixels of the SEM image. In addition, an area of a range (that is, the exposed core portion) indicated in a blue color was digitized by the number of pixels of the SEM image.

Step (4): A total area of the area of the range (the coating portion) indicated in a red color and the area of the range (the exposed core portion) indicated in a blue color was a surface area of the carrier particles. Accordingly, the ratio of the occupancy area of the coating portion to the surface area of the carrier particles was calculated.

Electrical resistivity of the carrier was measured by the following procedure.

Step (i): The carrier was attached to the magnet roller, and thus the carrier layer was formed on the magnet roller.

Step (ii): The carrier layer was in contact with the pair of aluminum electrodes having a predetermined distance (0.3 mm) therebetween (the aluminum electrodes were connected to each other through the carrier layer).

Step (iii): A predetermined voltage was applied between the aluminum electrodes, and a current flowing the carrier layer was measured, and thus resistance value (Ω) was obtained. Then, electrical resistivity was calculated from the resistance value (Ω), a cross-sectional area of the carrier layer ($cm^2$), and a distance between the pair of aluminum electrodes (cm).

The volume average particle diameter of the particle group of the carrier was measured by a laser diffraction type particle size distribution measurement device.

The additive agent included in the coating portion, the ratio (mass %) of the additive agent to the total amount of the coating portion, the coating portion/the core portion (mass ratio), the ratio (%) of the occupancy area of the coating portion to the surface area of the carrier particles, electrical resistivity ($\times 10^8$ Ω·cm), and the volume average particle diameter (μm) of each of the carriers are shown in Table 1.

TABLE 1

| Carrier | Additive Agent Included in Coating Portion | Color of Additive Agent | Ratio of Additive Agent to Total Amount of Coating Portion (Mass %) | Coating Portion/Core Portion (Mass Ratio) | Ratio of Occupancy Area of Coating Portion To Surface Area of Carrier Particles (%) | Electrical Resistivity ($\times 10^8$ Ω · cm) | Volume Average Particle Diameter (μm) |
|---|---|---|---|---|---|---|---|
| (1) | $TiO_2$ | White Color | 33 | 0.015 | 56 | 140 | 40 |

TABLE 1-continued

| Carrier | Additive Agent Included in Coating Portion | Color of Additive Agent | Ratio of Additive Agent to Total Amount of Coating Portion (Mass %) | Coating Portion/Core Portion (Mass Ratio) | Ratio of Occupancy Area of Coating Portion To Surface Area of Carrier Particles (%) | Electrical Resistivity ($\times 10^8$ Ω · cm) | Volume Average Particle Diameter (μm) |
|---|---|---|---|---|---|---|---|
| (2) | $TiO_2$ | White Color | 50 | 0.020 | 53 | 52 | 40 |
| (3) | None | — | 0 | 0.010 | 57 | 430 | 40 |
| (4) | None | — | 0 | 0.010 | 17 | 96 | 40 |
| (5) | Carbon Black | Black Color | 8.3 | 0.011 | 58 | 8.1 | 40 |
| (6) | Carbon Black | Black Color | 4.3 | 0.010 | 57 | 180 | 40 |
| (7) | Carbon Black | Black Color | 8.3 | 0.011 | 18 | 31 | 40 |
| (8) | None | — | 0 | 0.0040 | 16 | 33 | 40 |
| (9) | None | — | 0 | 0.0040 | 51 | 220 | 40 |
| (10) | Carbon Black | Black Color | 8.3 | 0.0044 | 51 | 0.54 | 40 |
| (11) | None | — | 0 | 0.015 | 58 | 740 | 40 |
| (12) | Carbon Black | Black Color | 8.3 | 0.016 | 60 | 220 | 40 |

Hereinafter, preparation and evaluation of developer (the first preparation and evaluation) will be described.

Examples 1 and 2 and Comparative Examples 1 to 10

The particle group of the decoloring toner and the particle group of each of the carriers shown in Table 1 were mixed by using a stirrer, and thus a developer of each example was prepared. The decoloring toner concentration in the developer was 8% mass with respect to the total amount of the developer. The carrier concentration in the developer was 92% mass with respect to the total amount of the developer.

Hereinafter, evaluation of electrification properties (an electrification amount and stabilization thereof) of the toner will be described.

The developer of each example was maintained for 8 hours under an environment of a temperature of 23° C. and relative humidity of 50%. After that, the electrification amount of the developer was measured by a suction type blow-off method (hereinafter, the electrification amount of the developer (μC/g) measured herein is denoted by an "initial [value ($Q^i$)").

Subsequently, the developer was stirred at 330 rpm for 240 minutes by using a stirrer. Immediately after the developer was stirred for 240 minutes (within 30 minutes after the stirring), the electrification amount of the developer was measured by the suction type blow-off method. Here, the measured electrification amount (μC/g) was a saturated value ($Q^s$) of the electrification amount of the developer.

Then, a difference ($Q^s$–$Q^i$) (μC/g) between the initial value ($Q^i$) and the saturated value ($Q^s$) was obtained. When the difference ($Q^s$–$Q^i$) is less than or equal to 18 (μC/g), the electrification amount is stabilized, and thus the decoloring toner is able to be excellently developed.

Hereinafter, evaluation of a decolored state due to the heating (the residual image of the erased color) will be described.

To evaluate the decolored state, a spectral density meter X-Rite (manufactured by X-Rite Inc.) is used.

A white paper on which no image is formed is prepared and a0*, b0*, and L0* of the white paper is measured by the X-Rite at first.

A solid image was printed on the white paper at a fixing temperature of 95° C. by an image forming apparatus (manufactured by Toshiba Tec Corporation, a product name of LP30) storing the developer of each example. Subsequently, the solid image printed on the white paper was heated at 160° C. and erased by an erasing machine (manufactured by Toshiba Tec Corporation, a product name of RD30). After that, a*, b*, and L* of a solid image portion after being eliminated were measured by the X-Rite.

Then, a color difference (ΔE) was calculated by the following Expression 1. The residual image of the erased color rarely occurs and the white paper which is the storage medium is easily reused as the value of ΔE becomes smaller.

$$\Delta E=\sqrt{(a^*-a_0^*)^2+(b^*-b_0^*)^2+(L^*-L_0^*)^2} \quad \text{[Expression 1]}$$

TABLE 2

| | | Evaluation | | | | |
|---|---|---|---|---|---|---|
| | | Electrification Amount of Developer | | | Decolored State Due to Heating | |
| Developer | Carrier | Initial Value $Q^i$ (μC/g) | Saturated Value $Q^s$ (μC/g) | Difference $Q^s$ – $Q^i$ (μC/g) | (Residual of Erased Color) | ΔE |
| Example 1 | (1) | 20.8 | 38.1 | 17.3 | A | 1.6 |
| Example 2 | (2) | 24.3 | 40.1 | 15.8 | A | 1.8 |
| Comparative Example 1 | (3) | 18.8 | 38.6 | 19.8 | A | 1.2 |

TABLE 2-continued

| | | Evaluation | | | | |
|---|---|---|---|---|---|---|
| | | Electrification Amount of Developer | | | Decolored State Due to Heating | |
| Developer | Carrier | Initial Value $Q^i$ (μC/g) | Saturated Value $Q^s$ (μC/g) | Difference $Q^s - Q^i$ (μC/g) | (Residual of Erased Color) | ΔE |
| Comparative Example 2 | (4) | 12.2 | 47.1 | 34.9 | A | 1.4 |
| Comparative Example 3 | (5) | 17.4 | 28.1 | 10.7 | B | 5.5 |
| Comparative Example 4 | (6) | 23.8 | 39.0 | 15.2 | B | 3.7 |
| Comparative Example 5 | (7) | 18.1 | 54.2 | 36.1 | B | 5.5 |
| Comparative Example 6 | (8) | 19.4 | 50.2 | 30.8 | A | 1.3 |
| Comparative Example 7 | (9) | 23.6 | 46.1 | 22.5 | A | 1.3 |
| Comparative Example 8 | (10) | 17.6 | 30.5 | 12.9 | B | 5.0 |
| Comparative Example 9 | (11) | 25.7 | 45.1 | 19.4 | A | 1.1 |
| Comparative Example 10 | (12) | 23.2 | 33.9 | 10.7 | B | 5.6 |

From an evaluation result of Table 2, it is able to be confirmed that a change in the electrification amount of the developer decreases at the time of stirring the developers of Examples 1 and 2. In addition, it is able to be confirmed that, when the developers of Examples 1 and 2 are used, the residual image of the erased color rarely occurs at the time of heating the image.

On the other hand, all of the developers of Comparative Examples 1 to 10 did not satisfy both of decreasing the change in the electrification amount of the developer and of the rare occurrence of the residual image of the erased color.

Hereinafter, a manufacturing example of the carrier (the second manufacturing example) will be described.

As described later, carriers (13) to (19) were manufactured by a dipping method, respectively.

Manufacturing of Carriers (13) to (16):

$TiO_2$ as the additive agent was dispersed in a solvent, and thus an additive agent dispersion liquid was prepared. Similar to the carrier (2) described above, the following carriers (13) to (16) were suitably manufactured by using the prepared additive agent dispersion liquid, respectively.

Carrier (13):

Additive Agent Included in Coating Portion: $TiO_2$,

Color of Additive Agent: White Color,

Ratio of Additive Agent to Total Amount of Coating Portion: 25 mass %, and

Coating Portion/Core Portion (Mass Ratio): 0.013.

Carrier (14):

Additive Agent Included in Coating Portion: $TiO_2$,

Color of Additive Agent: White Color,

Ratio of Additive Agent to Total Amount of Coating Portion: 55 mass %, and

Coating Portion/Core Portion (Mass Ratio): 0.022.

Carrier (15):

Additive Agent Included in Coating Portion: $TiO_2$,

Color of Additive Agent: White Color,

Ratio of Additive Agent to Total Amount of Coating Portion: 50 mass %, and

Coating Portion/Core Portion (Mass Ratio): 0.0080.

Carrier (16):

Additive Agent Included in Coating Portion: $TiO_2$,

Color of Additive Agent: White Color,

Ratio of Additive Agent to Total Amount of Coating Portion: 50 mass %, and

Coating Portion/Core Portion (Mass Ratio): 0.040.

Manufacturing of Carrier (17):

ZnO as the additive agent was dispersed in a solvent, and thus an additive agent dispersion liquid was prepared. Similar to the carrier (2) described above, a carrier (17) was suitably manufactured by using the prepared additive agent dispersion liquid.

Carrier (17):

Additive Agent Included in Coating Portion: ZnO,

Color of Additive Agent: White Color,

Ratio of Additive Agent to Total Amount of Coating Portion: 50 mass %, and

Coating Portion/Core Portion (Mass Ratio): 0.020.

Manufacturing of Carrier (18):

$Al_2O_3$ as the additive agent was dispersed in a solvent, and thus an additive agent dispersion liquid was prepared. Similar to the carrier (2) described above, a carrier (18) was suitably manufactured by using the prepared additive agent dispersion liquid.

Carrier (18):

Additive Agent Included in Coating Portion: $Al_2O_3$,

Color of Additive Agent: White Color,

Ratio of Additive Agent to Total Amount of Coating Portion: 50 mass %, and

Coating Portion/Core Portion (Mass Ratio): 0.020.

Manufacturing of Carrier (19):

$SnO_2$ as the additive agent was dispersed in a solvent, and thus an additive agent dispersion liquid was prepared. Similar to the carrier (2) described above, a carrier (19) was suitably manufactured by using the prepared additive agent dispersion liquid.

Carrier (19):

Additive Agent Included in Coating Portion: $SnO_2$,

Color of Additive Agent: White Color,

Ratio of Additive Agent to Total Amount of Coating Portion: 50 mass %, and

Coating Portion/Core Portion (Mass Ratio): 0.020.

In all of the carriers (13) to (19) described above, the ratio of the occupancy area of the coating portion to the surface area of the carrier particles exceeded 50%.

In addition, in all of the carriers (13) to (19), the electrical resistivity was between $8\times10^8$ and $8\times10^{10}$ (Ω·cm).

In addition, in all of the carriers (13) to (19), the volume average particle diameter was between 35 and 45 μm.

Hereinafter, preparation and evaluation of the developer (the second preparation and evaluation) will be described.

Examples 3 to 9

The particle group of the decoloring toner and the particle group of each of the carriers (13) to (19) were mixed by using a stirrer, and thus developers of Examples 3 to 9 were prepared, respectively. The decoloring toner concentration in the developer was 8 mass % with respect to the total amount of the developer. The carrier concentration in the developer was 92% mass with respect to the total amount of the developer.

Evaluation of the electrification properties of the toner described above (an electrification amount and stabilization thereof) and evaluation of a decolored state due to heating (the residual of the erased color) were performed with respect to each of the developers of Examples 3 to 9, respectively.

From a result thereof, it was confirmed that a change in the electrification amount of the developer was decreased at the time of stirring the developers of Examples 3 to 9. In addition, it was confirmed that, when the developers of Examples 3 to 9 were used, the residual of the erased color rarely occurred at the time of heating the image.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A developer for use in an image forming apparatus, the developer comprising:

a toner having a color erasable by heating; and a carrier including a core portion and a coating portion covering at least 50% of the core portion, the coating portion including a white-colored additive agent which suppresses an increase in electrification due to friction between the toner and the carrier, a mass of the additive agent being between 20% and 60% of a total mass of the coating portion, and an electrical resistivity of the carrier is between $8\times10^8$ and $8\times10^{10}$ (Ω·cm).

2. The developer according to claim 1, wherein the mass of the additive agent included in the coating portion is between 30% and 50% of the total mass of the coating portion.

3. The developer according to claim 1, wherein the electrical resistivity of the carrier is between $5\times10^9$ and $2\times10^{10}$ (Ω·cm).

4. The developer according to claim 1, wherein a ratio of a mass of the coating portion to a mass of the core portion is between 0.004 and 0.02.

5. The developer according to claim 4, wherein the ratio of the mass of the coating portion to the mass of the core portion is between 0.01 and 0.02.

6. The developer according to claim 1, wherein a mass of the carrier is between 90% and 93% of the total mass of the developer.

7. The developer according to claim 1, wherein a volume average particle diameter of a particle group of the carrier is between 37 μm and 43 μm.

8. The developer according to claim 1, wherein the toner includes a coloring agent and a binder resin, wherein a mass of the binder resin is between 60% and 80% of the total mass of the toner.

9. The developer according to claim 1, wherein when an image is formed with the erasable toner on a blank sheet having an initial color space of $a_0^*$, $b_0^*$ and $L_0^*$, and when the sheet having the erasable toner image fixed thereon is heated above a color erasing temperature, the erasable toner image has an erased color space of a*, b* and L* such that $[a^*-a_0^*)^2+(b^*-b_0^*)+(L^*-L_0^*)]^{1/2}$ is less than approximately 1.8.

10. The developer according to claim 1, wherein the carrier is manufactured by one of a fluid bed method and a dipping method.

11. A method of manufacturing a developer for use in an image forming apparatus, the method comprising the steps of:

forming a toner having a color erasable by heating;

forming a carrier including a core portion and a coating portion covering at least 50% of the core portion, the coating portion including a white-colored additive agent which suppresses an increase in electrification due to friction between the toner and the carrier, a mass of the additive agent being between 20% and 60% of a total mass of the coating portion, and an electrical resistivity of the carrier is between $8\times10^8$ and $8\times10^{10}$ (Ω·cm); and mixing the toner and the carrier.

12. The method according to claim 11, wherein the mass of the additive agent included in the coating portion is between 30% and 50% of the total mass of the coating portion.

13. The method according to claim 11, wherein the electrical resistivity of the carrier is between $5\times10^9$ and $2\times10^{10}$ (Ω·cm).

14. The method according to claim 11, wherein a ratio of a mass of the coating portion to a mass of the core portion is between 0.004 and 0.02.

15. The method according to claim 14, wherein the ratio of the mass of the coating portion to the mass of the core portion is between 0.01 and 0.02.

16. The method according to claim 11, wherein a mass of the carrier is between 90% and 93% of the total mass of the developer.

17. The method according to claim 11, wherein a volume average particle diameter of a particle group of the carrier is between 37 μm and 43 μm.

18. The method according to claim 11, wherein the toner includes a coloring agent and a binder resin, wherein a mass of the binder resin is between 60% and 80% of the total mass of the toner.

19. The method according to claim 11, wherein, when the developer is used in the image forming apparatus to form an image with the erasable toner on a blank sheet having an initial color space of $a_0^*$, $b_0^*$ and $L_0^*$, and when the sheet having the erasable toner image fixed thereon is heated above a color erasing temperature, the erasable toner image has an erased color space of a*, b* and L* such that $[a^*-a_0^*)^2+(b^*-b_0^*)+(L^*-L_0)]^{1/2}$ is less than approximately 1.8.

20. The method according to claim 11, wherein the carrier is manufactured by one of a fluid bed method and a dipping method.

* * * * *